US006953402B2

(12) United States Patent
Oyama

(10) Patent No.: US 6,953,402 B2
(45) Date of Patent: Oct. 11, 2005

(54) GOLF CLUB SHAFT

(75) Inventor: Hitoshi Oyama, Hyogo (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 09/949,806

(22) Filed: Sep. 12, 2001

(65) Prior Publication Data

US 2002/0052249 A1 May 2, 2002

(30) Foreign Application Priority Data

Sep. 12, 2000 (JP) ..... 2000-276307

(51) Int. Cl.[7] ..... A63B 53/10
(52) U.S. Cl. ..... 473/319
(58) Field of Search ..... 473/316–323; 156/187–188; 428/36.3, 36.9

(56) References Cited

U.S. PATENT DOCUMENTS 4,000,896 A 1/1977 Lauraitis ..... 473/319
5,265,872 A * 11/1993 Tennent et al. ..... 473/320
5,427,373 A 6/1995 Kusumoto
6,056,648 A 5/2000 Kusumoto et al. ..... 473/319

FOREIGN PATENT DOCUMENTS

| | | | |
|---|---|---|---|
| JP | 6-7764 | | 2/1994 |
| JP | 9-173516 | * | 7/1997 |
| JP | A9234256 | | 9/1997 |
| JP | B2-2705047 | | 10/1997 |
| JP | A10127838 | | 5/1998 |
| JP | 10-230030 | * | 9/1998 |

* cited by examiner

*Primary Examiner*—Stephen Blau
(74) *Attorney, Agent, or Firm*—Birch, Stewart, Kolasch & Birch, LLP

(57) ABSTRACT

A golf club shaft having a structure of a plurality of fiber reinforced prepregs layered one upon another. A grip-side reinforcing layer 6 (6A, 6B) and a head-side reinforcing layer 5 (5A, 5B, and 5C) are provided. In each of the grip-side reinforcing layer and the head-side reinforcing layer, a length of at least one of the prepregs is different from that of the other prepregs in an axial direction thereof, and the number of layers of the prepregs disposed at both ends of the golf club shaft is set larger than that of layers thereof disposed at a middle part of the golf club shaft.

8 Claims, 6 Drawing Sheets

GOLF CLUB SHAFT

BACKGROUND OF THE INVENTION

1. Field to the Invention

The present invention relates to a golf club shaft and more particularly to a golf club shaft which gives a golfer preferable feeling when the golfer swings and which is improved in the flight distance of a golf ball and a flight direction thereof.

2. Description of the Related Art

If the shaft is soft, i.e., if the flexure amount of the golf club shaft is set large, the golfer has a feeling that the shaft is flexible and obtains a soft feeling when the golfer hits the golf ball. Further the soft shaft has an advantage that the golf ball can fly a long distance owing to the restoring force of the flexed shaft. On the other hand, if the shaft is soft, the golfer feels that the shaft is unreliable and the flight direction is not uniform because the flexure amount is large.

On the other hand, if the shaft is hard, i.e., if the flexure amount of the golf club shaft is set small, the golfer has a feeling of stiffness. Thus the golfer can swing powerfully with a feeling of safety. Further the hard shaft allows both the flight distance of a golf ball and its flight direction to be uniform. However, the golfer does not feel that the shaft is flexible. That is, the golfer feels that the shaft is hard and cannot flex it sufficiently when the golfer hits the golf ball, which causes the flight distance of the golf ball to be shorter.

As described above, to give "feeling of flexibility" to the golfer and increase a "flight distance" by making the shaft soft is reciprocal to give "feeling of stiffness" to the golfer and make the flight direction uniform by making it hard. Therefore, various proposals have been made to make the "feeling of flexibility" and the "feeling of stiffness" compatible with each other and increase of the "flight distance" and the stability of the "flight direction" compatible with each other.

For example, in Japanese Patent Application Laid-Open No. Hei 9-234256, there is disclosed a golf club shaft having the region having a high torsional rigidity at the grip part thereof and the front end (head) and the region having a high flexural rigidity in the center thereof. In Japanese Patent Application Laid-Open No. Hei 10-127838, there is disclosed a golf club shaft having the region having a maximum flexural rigidity not at the grip part but at the front end (head).

In Japanese Patent Publication No. 2705047, there is disclosed a golf club shaft having reinforcing layers of different lengths layered one upon another, with the ends of the reinforcing layers coincident with one another in the rear end (grip side) of the shaft. The ends of the wound fiber reinforced synthetic resinous sheets are butted on each other to make the rigidity of the shaft uniform in its circumferential direction. In Japanese Utility Model Application Laid-Open No. Hei 6-7764, there is disclosed a golf club shaft having a plurality of reinforcing layers having different lengths so constructed as to increase the rigidity of the shaft toward the grip side thereof.

However, in the golf club shaft of Japanese Patent Application Laid-Open No. Hei 9-234256, because the shaft has the high flexural rigidity in its central portion, a sufficient degree of flexibility cannot be obtained. Further because the behavior of the shaft during swinging is different from that of the conventional shaft, the shat has a problem that a golfer has difficulty in taking a timing.

In the golf club shaft disclosed in Japanese Patent Application Laid-Open No. Hei 10-127838, because the region having the maximum flexural rigidity is formed not at the grip side but at the front end (head), and attention is not paid to the rigidity of the grip part, the grip part has a low rigidity and is liable to deform when the golfer swings. Thus when the golfer swings, the golfer cannot have feeling of security or swing with all the golfer's might. Further the it is difficult for the golfer to swing in an uniform style. There is no disclosure of the layered construction of a fiber reinforced prepreg composing the shaft. It is necessary to provide the golf club shaft with a complicated layered construction of the fiber reinforced prepreg to form the region having the maximum flexural rigidity not at the grip part but at the front portion (head) of the golf club shaft. In this case, there is a restriction in the manufacture of the golf club shaft.

Both the golf club shaft disclosed in Japanese Patent Publication No. 2705047 and that disclosed in Japanese Utility Model Application Laid-Open No. Hei 6-7764 have a smaller outer diameter than that of the conventional golf club shaft. Because no attention is paid to the rigidity of the golf club shaft at its head side, the golf club shaft lacks stability in the flight direction of the golf ball. These golf club shafts have another problem that much consideration is not taken for the golfer's feeling. That is, the golfer has an uncomfortable feeling when the golfer hits the golf ball.

SUMMARY OF THE INVENTION

The present invention has been made in view of the above-described problems. Therefore it is an object of the present invention to provide a golf club shaft which allows a golfer to feel both "feeling of flexibility" and "feeling of stiffness" when he golfer hits a golf ball and allows "flight distance" to be increased and "flight direction" to be uniform.

To achieve the object, according to the present invention, there is provided a golf club shaft having a structure of a plurality of fiber reinforced prepregs layered one upon another. In this construction, in each of the grip-side reinforcing layer and the head-side reinforcing layer, a length of at least one of the prepregs is different from that of the other prepregs in an axial direction thereof (the longitudinal direction of the golf club shaft). In each of the grip-side reinforcing layer and the head-side reinforcing layer, the number of layers of the prepregs disposed at both ends of the golf club shaft is set larger than that of layers of the prepregs disposed at a middle part of the golf club shaft where the prepregs of the grip-side reinforcing layer and those of the head-side reinforcing layer are proximate to each other. The prepregs of the head-side reinforcing layer and the prepregs of the grip-side reinforcing layer are so disposed that ends of the prepregs of the head-side reinforcing layer disposed at the middle part of the golf club shaft and those of the prepregs of the grip-side reinforcing layer disposed at the middle part of the golf club shaft do not overlap each other.

According to the present invention, the reinforcing layer is formed from both ends (front end, namely, head side and rear end, namely, grip side) of the shaft toward its center to increase the rigidity of the head-side end of the shaft and that of the grip-side end thereof. Further to decrease the rigidity of the middle part (portion where the head-side reinforcing layer and the grip-side reinforcing layer do not overlap each other) of the shaft, the prepregs of the head-side reinforcing layer and the prepregs of the grip-side reinforcing layer are so constructed that ends of the prepregs of the head-side reinforcing layer disposed at the middle part of the shaft and those of the prepregs of the grip-side reinforcing layer disposed at the middle part of the shaft do not overlap each other. Thereby it is possible to increase the flight distance of the golf ball owing to a high degree of flexibility of the shaft and make the flight direction of the golf ball uniform and further allow the golfer to have a feeling of stiffness and flexibility.

More specifically, the shaft has the head-side reinforcing layer to increase the flexural rigidity of the head side of the shaft. Thereby it is possible to prevent the head side of the shaft from flexing and allow the "flight direction" uniform.

The shaft has the grip-side reinforcing layer to increase the flexural rigidity of the grip part. Thereby it is possible to reduce the deformation amount of the grip part. Thus the golfer can have the "feeling of stiffness" when the golfer hits the golf ball and can swing with the sense of security. Thus it is unnecessary for the golfer to grasp the grip part tightly to prevent the deformation of the grip part. That is, it is unnecessary for the golfer to exert all her/his power. Therefore, the golfer can swing stably and allows the "flight direction" to be uniform.

Further because the rigidity of the middle part of the shaft is set in a comparatively low extent, the shaft deforms sufficiently when the golfer swings and the increase of the "flight distance" can be brought about by the restoring force of the shaft. Further the golfer can obtain the "feeling of flexibility".

In each of the grip-side reinforcing layer and the head-side reinforcing layer, the length of at least one of the prepregs is different from that of the other prepregs in an axial direction thereof (the longitudinal direction of the golf club shaft). Further in each of the grip-side reinforcing layer and the head-side reinforcing layer, the number of layers of the prepregs disposed at both ends of the golf club shaft is set larger than that of layers of the prepregs disposed at a middle part of the golf club shaft. The prepregs of different lengths are layered one upon another to form each reinforcing layer stepwise. Thereby it is possible to prevent the rigidity thereof from changing suddenly, which prevents the golfer from having a feeling of discomfort when the golfer swings. Because there is no portion where the rigidity changes suddenly, it is possible to prevent breakage of the shaft. Accordingly, the shaft of the present invention gives a good feeling to the golfer when the golfer swings and does not have a problem in its strength. Further because the number of the layers of the prepregs at the end portion of the shaft is set more than that of the layers of the prepregs at the middle part of the shaft, it is possible to enhance the rigidity of the end portion of the shaft. The axial direction of the prepreg means the longitudinal direction of the shaft.

The end portion of the prepreg of each reinforcing layer disposed at the middle part of the shaft may be cut to make each reinforcing layer stepwise naturally, so that smooth distribution of the rigidity of each reinforcing layer is accomplished.

More specifically, let it be supposed that the number of prepregs are layered on each reinforcing layer is indicated by n, and that the lengths of the prepregs of each reinforcing layer in the axial direction thereof are indicated by $L_1$, $L_2$, $L_3 \ldots$, $L_n$ in the order from shorter prepregs. In this case, the difference $(L_{k+1}-L_k)(k \leqq n)$ between the lengths of the adjacent prepregs is favorably in the range of not less than 4% nor more than 30% of the entire length of the shaft, more favorably in the range of not less than 4% nor more than 20% thereof, and more favorably in the range of not less than 8% nor more than 20% thereof. If the difference $(L_{k+1}-L_k)$ is smaller than 4%, the effect of making the distribution of the rigidity uniform is low. On the other hand, if the difference $(L_{k+1}-L_k)$ is larger than 30%, there is little change of the rigidity of the shaft. Thus the effect of the present invention of reinforcing the shaft partly cannot be displayed. For the above-described reason, it is preferable that each reinforcing layer has many prepregs. But if each reinforcing layer has too many prepregs, the number of windings increases and hence low productivity. Thus it is not preferable to dispose too many prepregs in each reinforcing layer.

The position of a front side end (head-side end) of the prepreg of the head-side reinforcing layer is located in the range of not less than 0% nor more than 25% of the whole length of the shaft, from at a front side end (head-side end) of the shaft. It is more favorably not less than 0% nor more than 20%, and most favorably not less than 0% nor more than 15% from the front side end of the shaft.

To suppress the variation of the flight direction, it is important to reinforce the head part of the shaft and its neighborhood on which a stress acts strongly to increase the rigidity of the head part of the shaft and its neighborhood. The golf ball is hop-flied caused by shortage of the flexural rigidity in the neighborhood of the head-installing portion and a flexure of the shaft in the direction that a loft degree of the head inclines horizontal at the time of an impact of the head on the golf ball. Because the head-side reinforcing layer is formed in the above-described range, it is possible to prevent the golf ball from being hop-flied and allow the "flight direction" to be uniform.

Normally, the shaft is inserted into the neck of the head in the range of 30 mm to 50 mm (about 2%–6% of the entire length of the shaft). By disposing the head-side reinforcing layer in the above-described range, it is possible to reinforce the end surface of the neck on which the stress concentrates in the highest extent. Thus it is possible to prevent breakage of the shaft.

The position of a rear side end (grip-side end) of the prepreg of the grip-side reinforcing layer is set in the range of not less than 0% nor more than 25% of the whole length of the shaft, from at a rear side end (grip-side end) of the shaft. It is more favorably not less than 0% nor more than 20% of the whole length thereof, and most favorably not less than 4% nor more than 10% of the whole length thereof from the rear-end of the shaft.

If the position of the rear side end of the prepreg of the grip-side reinforcing layer is not set to the range not less than 0% nor more than 25% of the whole length of the shaft from the rear side end of the shaft, the grip part of the shaft is not reinforced. In this case, it is impossible to increase the rigidity of the grip part.

As described above, it is most favorable that the position of the rear side end of the prepreg of the grip-side reinforcing layer is located in the range of not less than 4% nor more than 10% of the whole length of the shaft from the rear side end of the shaft. This is because the cost of the material for the shaft can be reduced. The range of not less than 4% nor more than 10% of the whole length of the shaft from the rear-end of the shaft is not so effective for increasing the rigidity of the grip part. That is, owing to the setting of the location of the prepreg to the above range, the cost of the material for the shaft can be reduced and the effect of the present invention can be maintained. Another advantage which is obtained by spacing the grip-side reinforcing layer a little from the grip-side end of the shaft is that the grip can be installed on the shaft easily because the diameter of the shaft at its grip-side end can be reduced.

The axial length of each of the prepregs of each of the head-side reinforcing layer and the grip-side reinforcing layer is set to a range of not less than 5% nor more than 70%, favorably not less than 5% nor more than 52%, more favorably not less than 5% nor more than 35%, and most favorably not less than 20% nor more than 35%. If the length of the prepreg of the head-side reinforcing layer and the grip-side reinforcing layer is too small (smaller than 5% of entire length of shaft), a substantial reinforcing effect is lost. On the other hand, if the length of the prepreg of the head-side reinforcing layer and the grip-side reinforcing layer is too large (larger than 70% of entire length of shaft), the rigidity of the entire shaft increases. Thus the effect of the present invention of reinforcing the shaft partly cannot be displayed.

The number of prepregs of each of the head-side reinforcing layer and the grip-side reinforcing layer is not less than two nor more than eight, favorably not less than two nor more than six, and more favorably not less than two nor more than four. This is because unless the number of prepregs of each of the head-side reinforcing layer and the grip-side reinforcing layer is not less than two, it is impossible to make the distribution of the rigidity of the shaft uniform. On the other hand, if the number of prepregs of each of the head-side reinforcing layer and the grip-side reinforcing layer is not less than eight, the winding number of the prepregs increases. Thus the productivity is low.

The head-side reinforcing layer and the grip-side reinforcing layer are extended from a head-side end of the shaft and a grip-side end thereof respectively, with the head-side ends of the prepregs thereof coincident with one another in an axial direction of the golf club shaft and with the grip-side ends of the prepregs thereof coincident with one another in the axial direction thereof. The number of layers of the prepregs is gradually decreased toward the middle part of the golf club shaft to thereby gradually increase a rigidity of the golf club shaft from the middle part to the end of a grip part thereof and that of a head part thereof. Thereby it is possible to efficiently increase the rigidity of the head-side end and the grip-side end of the shaft and decrease the rigidity of the middle part of the shaft.

The head-side reinforcing layer has a bias layer composed of the prepregs having fibrous angles of ±30°–±50° with respect to the axial direction of the golf club shaft. Thereby it is possible to increase the rigidity of the head side of the shaft and in particular the torsional rigidity of the shaft. Thus it is possible to suppress the variation of the flight direction.

The grip-side reinforcing layer has a straight layer composed of the prepregs having fibrous angles of 0° with respect to the axial direction of the golf club shaft. This construction allows the increase of the flexural rigidity of the grip part. Thereby it is possible to reduce the deformation amount of the grip part. Thus the golfer can have the "feeling of stiffness" when the golfer hits the golf ball. Thus it is unnecessary for the golfer to grasp the grip part tightly to prevent the deformation of the grip part. That is, it is unnecessary for the golfer to exert all her/his power. Therefore, the golfer can swing stably and allows the "flight direction" to be uniform.

The middle part of the golf club shaft is provided with a non-reinforcing portion where the prepregs of the head-side reinforcing layer and those of the grip-side reinforcing layer are not disposed; and a length of the non-reinforcing portion is set to not less than 10% nor more than 60% of the whole length of the golf club shaft. By setting the length of the non-reinforcing portion to the above-described range, it is possible to decrease the rigidity of the middle part of the shaft. Thus the shaft is sufficiently flexible in its middle part and hence capable of allowing the increase of the flight distance.

By setting that the fibrous angle of the prepreg for the use of the head-side reinforcing layer to 0° (straight layer) with respect to the axial direction of the shaft to increase the flexural rigidity of the head-side region of the shaft, a high-class golfer who hits a golf ball at a high head speed can fly the golf ball along a favorable trajectory without the golf ball being hop-flied.

The shaft of the present invention is applicable to a wood club, an iron club, a patter, and other kinds of golf clubs.

DETAILED DESCRIPTION OF THE PREFERRED EMBODIMENTS

The embodiments of the present invention will be described below with reference to drawings.

Figure 1:
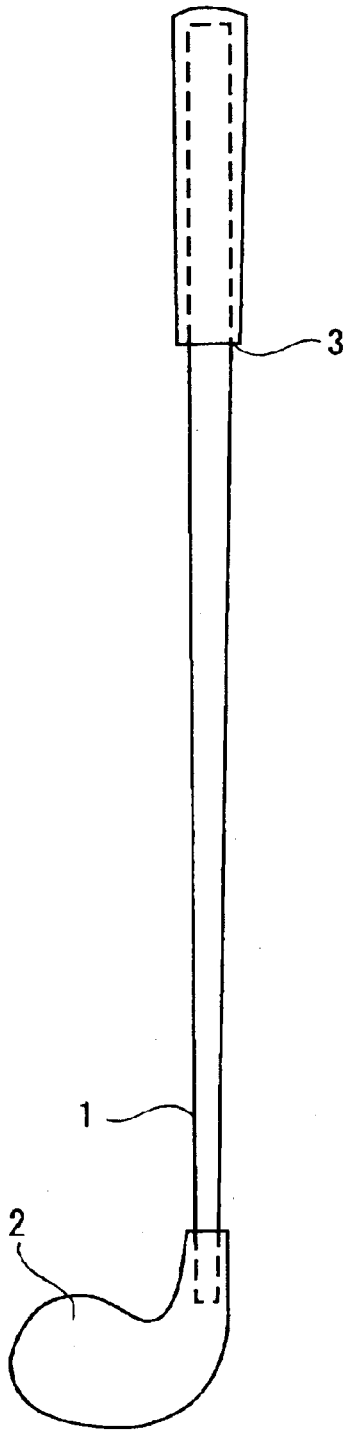
FIG. 1 shows a golf club shaft according to a first embodiment of the present invention.

FIG. 1 shows a golf club shaft (hereinafter referred to as merely shaft) according to a first embodiment of the present invention. A shaft 1 is composed of fiber reinforced prepregs layered one upon another. A head 2 is installed on the shaft 1 at one end (front side end) thereof having the smaller diameter. A grip 3 is installed on the shaft 1 at the other end (rear side end) thereof having the larger diameter.

Figure 2:
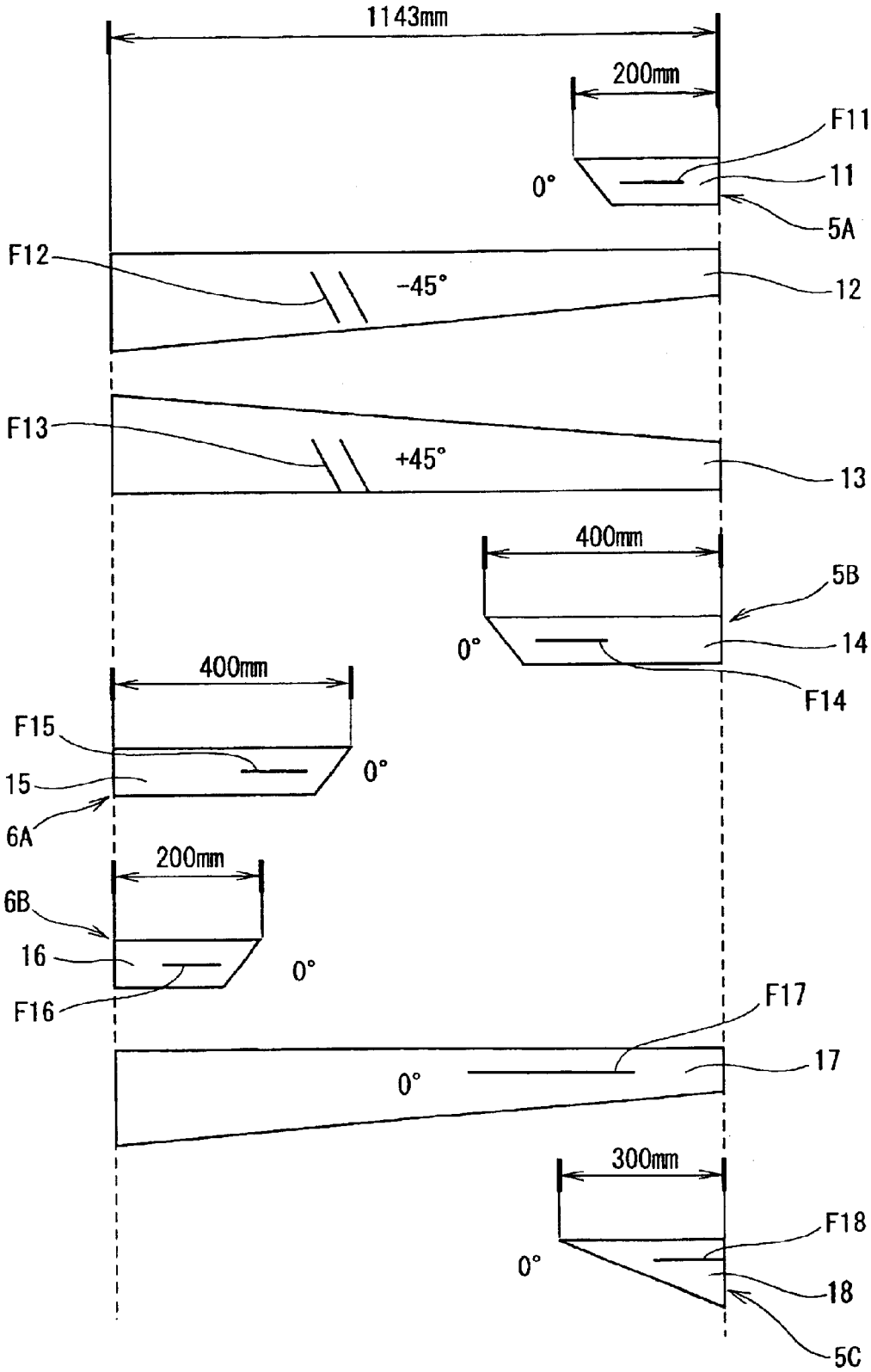
FIG. 2 shows a fiber reinforced prepreg for the use of a golf club shaft of the first embodiment of the present invention.

The shaft 1 is made of fiber reinforced prepregs 11 18, shown in FIG. 2, wound on a core metal (not shown) from the inner peripheral side thereof. Carbon fiber is used for reinforcing fibers F11–F18 of the fiber reinforced prepregs 11–18. Epoxy resin is used as the matrix resin of the fiber reinforced prepregs 11–18.

A head-side reinforcing layer 5A composed of the fiber reinforced prepreg 11 has a length of 200 mm. The larger-size side of the fiber reinforced prepreg is set so as to wound twice. The orientation angle of the reinforcing fiber F11 with respect to the axis of the shaft 1 is 0°, and fiber reinforced prepreg 11 is disposed at the head side.

The fiber reinforced prepregs 12 and 13 have a length of 1143 mm respectively. The larger-size side of the fiber reinforced prepreg is set so as to wound three times. The orientation angle of the reinforcing fibers F12 and F13 with respect to the axis of the shaft 1 is −45° and +45° respectively.

A head-side reinforcing layer 5B composed of the fiber reinforced prepreg 14 has a length of 400 mm. The larger-size side of the fiber reinforced prepreg is set so as to wound once. The orientation angle of the reinforcing fiber F14 with respect to the axis of the shaft 1 is 0°.

A grip-side reinforcing layer 6A composed of the fiber reinforced prepreg 15 has a length of 400 mm. The larger-size side of the fiber reinforced prepreg is set so as to wound once. The orientation angle of the reinforcing fiber F14 with respect to the axis of the shaft 1 is 0°, and the fiber reinforced prepreg 15 is disposed at the grip side.

A grip-side reinforcing layer 6B composed of the fiber reinforced prepreg 16 has a length of 200 mm. The larger-size side of the fiber reinforced prepreg is set so as to wound once. The orientation angle of the reinforcing fiber F16 with respect to the axis of the shaft 1 is 0°.

The fiber reinforced prepreg 17 has a length of 1143 mm. The larger-size side of the fiber reinforced prepreg is set so as to wound twice. The orientation angle of the reinforcing fiber F17 with respect to the axis of the shaft 1 is 0°.

A head-side reinforcing layer 5*c* composed of the fiber reinforced prepreg 18 has a length of 300 mm. The larger-size side of the fiber reinforced prepreg is set so as to wound seven times. The orientation angle of the reinforcing fiber F18 with respect to the axis of the shaft 1 is 0°.

In each of a plurality of the head-side reinforcing layers 5 (5A, 5B, and 5C) and a plurality of the grip-side reinforcing layers 6 (6A and 6B), the axial length of at least one prepreg is different from that of other prepregs. The head-side reinforcing layers 5 (5A, 5B, and 5C) and the grip-side reinforcing layers 6 (6A and 6B) do not overlap each other at ends thereof at the middle part side of the shaft 1.

The end of the prepreg of each of the head-side reinforcing layers 5 (5A, 5B, and 5C) is disposed from the front end (head side) of the shaft 1 to a position located in the range of not less than 0% nor more than 25% of the whole length of the shaft 1. The end of the prepreg of each of the grip-side reinforcing layers 6 (6A and 6B) is disposed from the rear end (grip side) of the shaft 1 to a position located in the range of not less than 0% to nor more than 25% of the whole length of the shaft 1. The length of the prepreg of each of the head-side reinforcing layers 5 (5A, 5B, and 5C) and the grip-side reinforcing layers 6 (6A and 6B) is set to the range of not less than 5% nor more than 70% of the whole length of the shaft 1.

The head-side reinforcing layer 5 (5A, 5B, and 5C) and the grip-side reinforcing layer 6 (6A, 6B) are extended from the head-side end of the shaft and the grip-side end thereof respectively, with the head-side ends of the prepregs thereof coincident with one another in the axial direction of the golf club shaft and with the grip-side ends of the prepregs thereof coincident with one another in the axial direction thereof. The number of layers of the prepregs is gradually decreased toward the middle part of the golf club shaft, so that the rigidity of the golf club shaft gradually increase from the middle part to the end of the grip part thereof and that of the head part thereof. The grip-side reinforcing layer 6 (6A and 6B) is composed of prepregs whose fibrous angles are 0° with respect to the axial direction of the shaft. The middle part of the shaft is provided with a non-reinforcing portion where the prepregs of both reinforcing layers are not disposed. The length of the non-reinforcing portion is set to not less than 10% nor more than 60% of the whole length of the shaft. (In the first embodiment, the length of the non-reinforcing portion is set to 343 mm, namely, 30% of the whole length of the shaft.)

The shaft 1 is manufactured by a sheet winding method. That is, the carbon fiber reinforced prepregs 11–18 including the head-side reinforcing layer 5 (5A, 5B, and 5C) and the grip-side reinforcing layer 6 (6A and 6B) are wound on the core metal (not shown) sequentially (fiber reinforced prepregs 11→12→ . . . 18) and layered one upon another. Thereafter, the layered fiber reinforced prepregs 11–18 are heated under pressure in an oven, with the fiber reinforced prepregs 11–18 wrapped with a tape made of polyethylene terephthalate resin. Thereby the terephthalate resin is hardened to perform integral molding. Then the core metal is pulled out to form the shaft 1.

At least one pair of bias layers (fibrous angle is ±30°–±50° with respect to the axial direction of the shaft) may be formed as the head-side reinforcing layer of the shaft 1. In the layered structure of the shaft 1 shown in FIG. 3, there are provided two pairs of bias layers of the head-side reinforcing layer consisting of fiber reinforced prepregs 21 and 22 and the grip-side reinforcing layer consisting of fiber reinforced prepregs 28 and 29.

Figure 4:
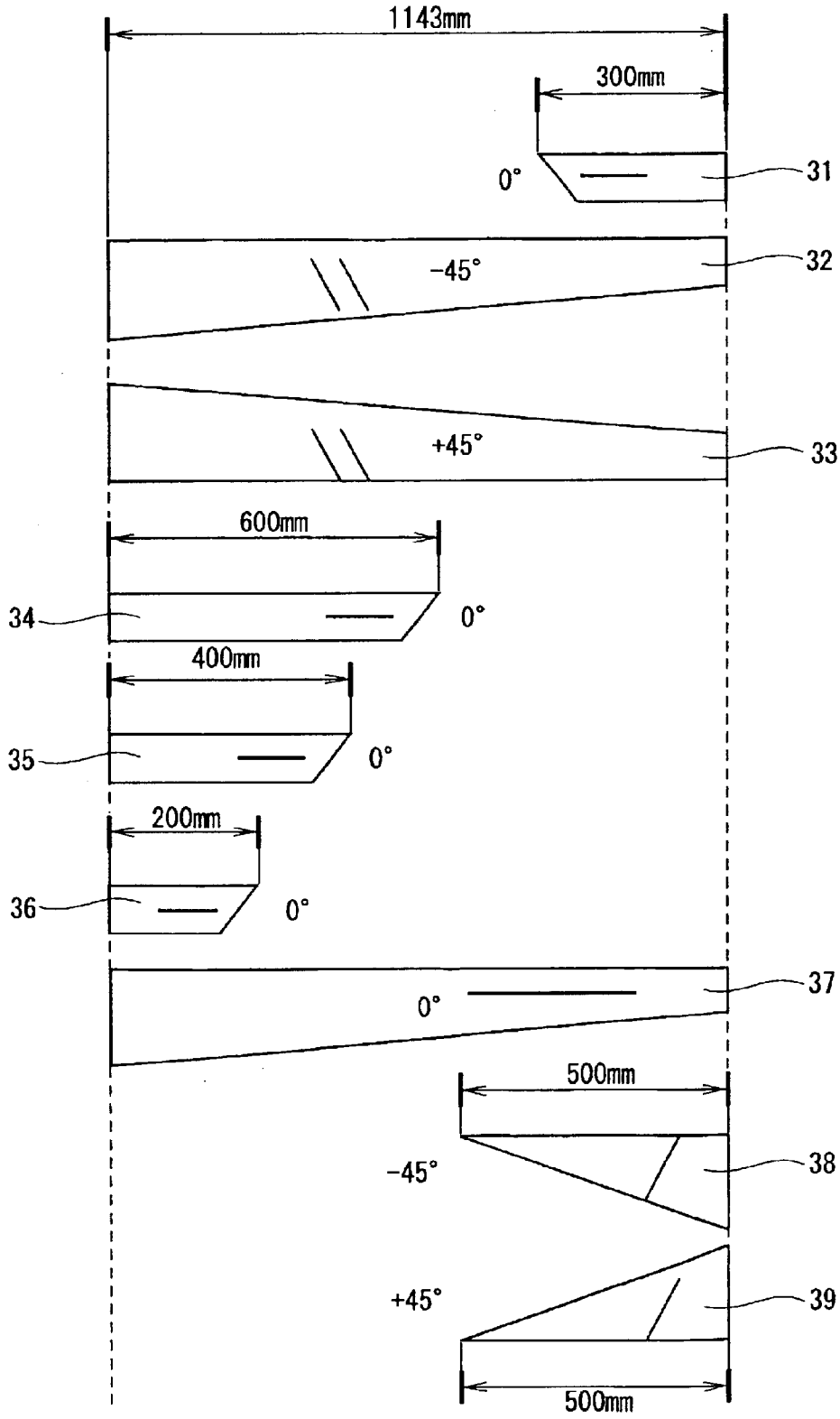
FIG. 4 shows a fiber reinforced prepreg for the use of a golf club shaft of a third embodiment of the present invention.

In the layered structure of the shaft 1 shown in FIG. 4, there are provided a pair of bias layers of the head-side reinforcing layer composed of fiber reinforced prepregs 38 and 39.

The golf club shaft of examples 1–4 of the present invention and comparison example 1 will be described below in detail.

The golf club shaft of each of the examples 1–4 of the present invention and that of comparison example 1 were prepared by using fiber reinforced prepregs having the specifications shown in table 1. Table 1 shows the properties of the fiber reinforced prepregs (carbon fiber reinforced prepreg) such as the material names thereof, the kinds of the fiber, and the like.

TABLE 1

| Name of materials | Kind of fiber | Elastic modulus (Mpa) | Density | Amount of carbon fiber ($g/m^2$) | Amount of resin (%) | Thickness (mm) | Maker |
|---|---|---|---|---|---|---|---|
| MR350C-125S | MR40 | 4410 | 1.76 | 125 | 25 | 0.104 | Mitsubishi Rayon Corp. |
| NR350C-100S | MR40 | 4410 | 1.76 | 100 | 25 | 0.083 | Mitsubishi Rayon Corp. |
| MR350C-050S | NR40 | 4410 | 1.76 | 50 | 25 | 0.048 | Mitsubishi Rayon Corp. |
| TR350C-100S | TR50S | 4900 | 1.82 | 100 | 25 | 0.083 | Mitsubishi Rayon Corp. |

EXAMPLE 1

The golf club shaft of the example 1 had a layered construction of the example 1 as shown in FIG. 2. The fiber reinforced prepregs 11→12→ . . . 18 were wound on a core metal sequentially from the inner peripheral side thereof and layered one upon another.

As the fiber reinforced prepregs 11, 14–16, 18, TR350C-100S was used. As the fiber reinforced prepregs, 12, 13, and 17, MR350C-100S was used.

The lengths and fibrous angles of the fiber reinforced prepegs are as shown in FIG. 2.

The fiber reinforced prepreg 18 was wound seven times. The fiber reinforced prepregs 12 and 13 were wound three times respectively. The fiber reinforced prepregs 11 and 17 were wound two times respectively. The fiber reinforced prepregs 14, 15, and 16 were wound once respectively. The fiber reinforced prepregs were layered one upon another (number of times at the large-size side) to prepare a shaft according to the above-described method.

The head-side reinforcing layers (fiber reinforced prepregs 11, 14, and 18) were disposed from the head-side end of the shaft at the position of 0% of the entire length thereof and layered one upon another, whereas the grip-side reinforcing layer (fiber reinforced prepregs 15 and 16) was disposed from the grip-side end of the shaft at the position of 0% of the entire length thereof and layered on each other.

EXAMPLE 2

Figure 3:
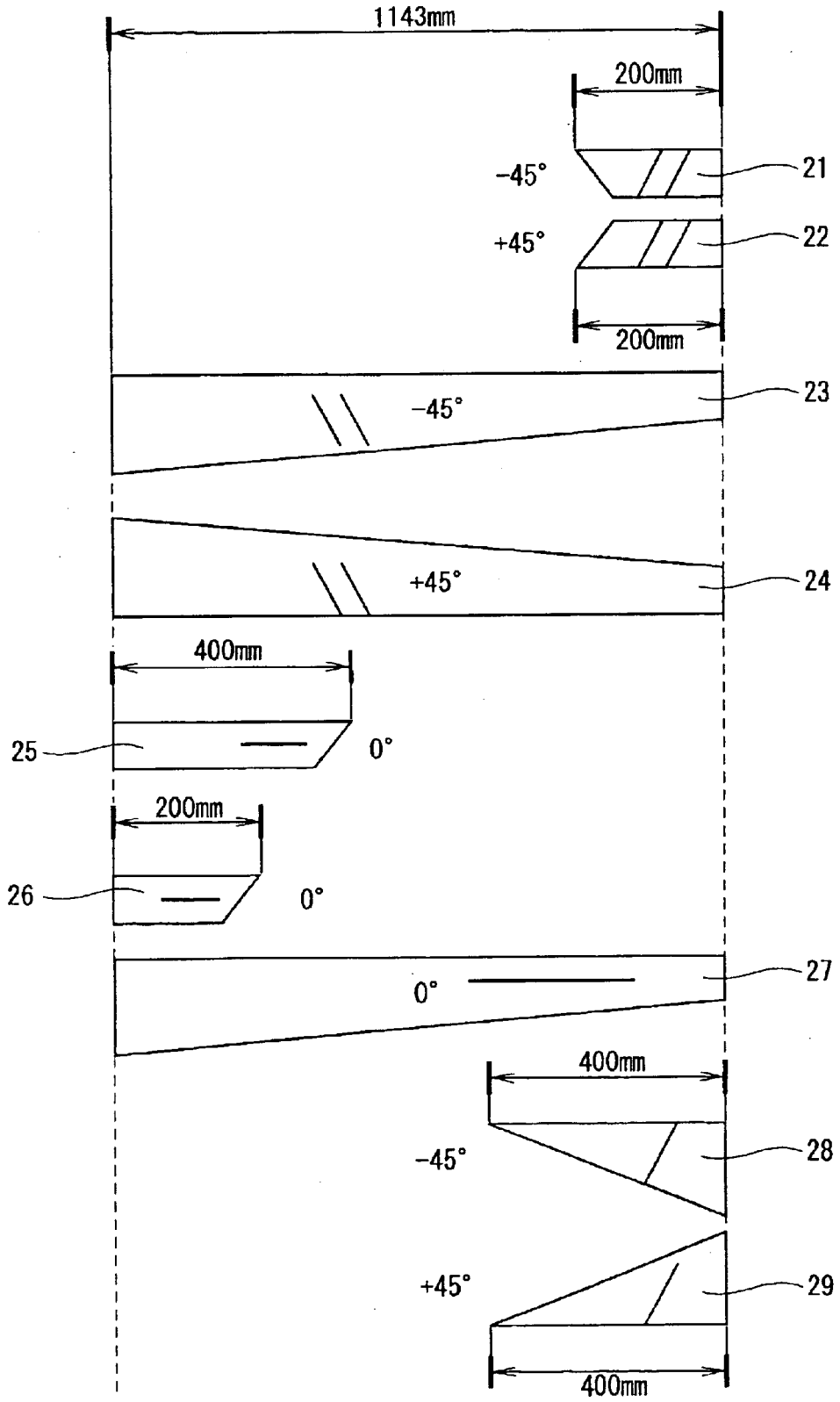
FIG. 3 shows a fiber reinforced prepreg for the use of a golf club shaft of a second embodiment of the present invention.

The golf club shaft of the example 2 had a layered construction shown in FIG. 3. The fiber reinforced prepregs 21→22→ . . . 29 were wound on a core metal sequentially from the inner peripheral side thereof and layered one upon another.

As fiber reinforced prepregs 21, 22, 28, and 29, MR350C-050S was used. As fiber reinforced prepregs, 23, 24, and 27, MR350C-100S was used. As fiber reinforced prepregs 25 and 26, TR350C-100S was used.

The lengths and fibrous angles of the fiber reinforced prepregs are as shown in FIG. 3.

The fiber reinforced prepregs 28 and 29 were wound eight times. The fiber reinforced prepregs 23 and 24 were wound three times respectively. The fiber reinforced prepregs 21, 22, and 27 were wound two times respectively. The fiber reinforced prepregs 25 and 26 were wound once respectively. The fiber reinforced prepregs were layered one upon another (number of times at the large-size side) to prepare a shaft by the above-described method.

The head-side reinforcing layer (fiber reinforced prepregs 21, 22, 28, and 29) was disposed from the head-side end of the shaft at the position of 0% of the entire length thereof and layered one upon another, whereas the grip-side reinforcing layer (fiber reinforced prepregs 25 and 26) was disposed from the grip-side end of the shaft at the position of 0% of the entire length thereof and layered on each other.

EXAMPLE 3

The golf club shaft of the example 3 had a layered construction shown in FIG. 4. The fiber reinforced prepregs 31→32→ . . . 39 were wound on a core metal sequentially from the inner peripheral side thereof and layered one upon another.

As fiber reinforced prepregs 31, 34–36, TR350C-100S was used. As fiber reinforced prepregs 32 and 33, MR350C-100S was used. As a fiber reinforced prepreg 37, MR350C-125S was used. As fiber reinforced prepregs 38 and 39, MR350C-050S was used.

The lengths and fibrous angles of the fiber reinforced prepregs are as shown in FIG. 4.

The fiber reinforced prepregs 38 and 39 were wound eight times. The fiber reinforced prepregs 12 and 13 were wound three times respectively. The fiber reinforced prepregs 32 and 33 were wound three times respectively. The fiber reinforced prepreg 31 was wound twice. The fiber reinforced prepregs 34–37 were wound once respectively. The fiber reinforced prepregs were layered one upon another (number of times at the large-size side) to prepare a shaft by the above-described method.

The head-side reinforcing layer (fiber reinforced prepregs 31, 38, and 39) was disposed from the head-side end of the shaft at the position of 0% of the entire length thereof and layered one upon another, whereas the grip-side reinforcing layer (fiber reinforced prepregs 34–36) was disposed from the grip-side end of the shaft at the position of 0% of the entire length thereof and layered one upon another.

EXAMPLE 4

Figure 5:
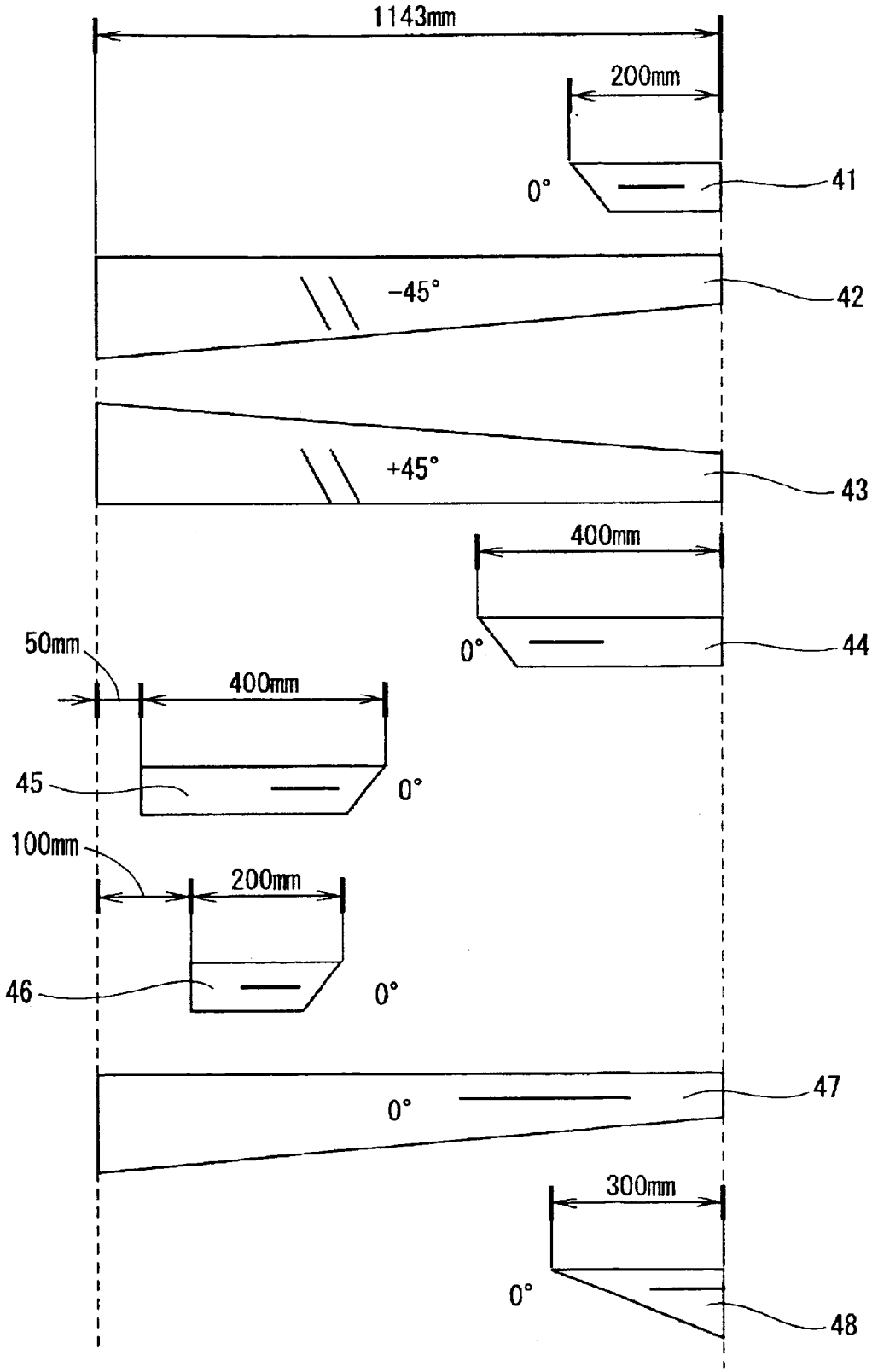
FIG. 5 shows a fiber reinforced prepreg for the use of a golf club shaft of a fourth embodiment of the present invention.

The golf club shaft of the example 4 had a layered construction shown in FIG. 5. The fiber reinforced prepregs 41→42→ . . . 48 were wound on a core metal sequentially from the inner peripheral side thereof and layered one upon another.

As fiber reinforced prepregs 41, 44–46, and 48, TR350C-100S was used. As fiber reinforced prepregs 42, 43, and 47, MR350C-100S was used.

The lengths and fibrous angles of the fiber reinforced prepregs are as shown in FIG. 5.

The fiber reinforced prepreg 48 was wound seven times. The fiber reinforced prepregs 42 and 43 were wound three times respectively. The fiber reinforced prepregs 41 and 47 were wound twice respectively. The fiber reinforced prepregs 44, 45, and 46 were wound once. The fiber reinforced prepregs were layered one upon another (number of times at the large-size side) to prepare a shaft by the above-described method.

The head-side reinforcing layer (fiber reinforced prepregs 41, 44, and 48) was disposed from the head-side end of the shaft at the position of 0% of the entire length thereof and layered one upon another, whereas the grip-side reinforcing layer (fiber reinforced prepregs 45 and 46) was disposed from the grip-side end of the shaft in such a way that the fiber reinforced prepreg 45 was located at the position of 4% of the whole length of the shaft and that the fiber reinforced prepreg 46 was located at the position of 9% of the whole length of the shaft.

COMPARISON EXAMPLE 1

Figure 6:
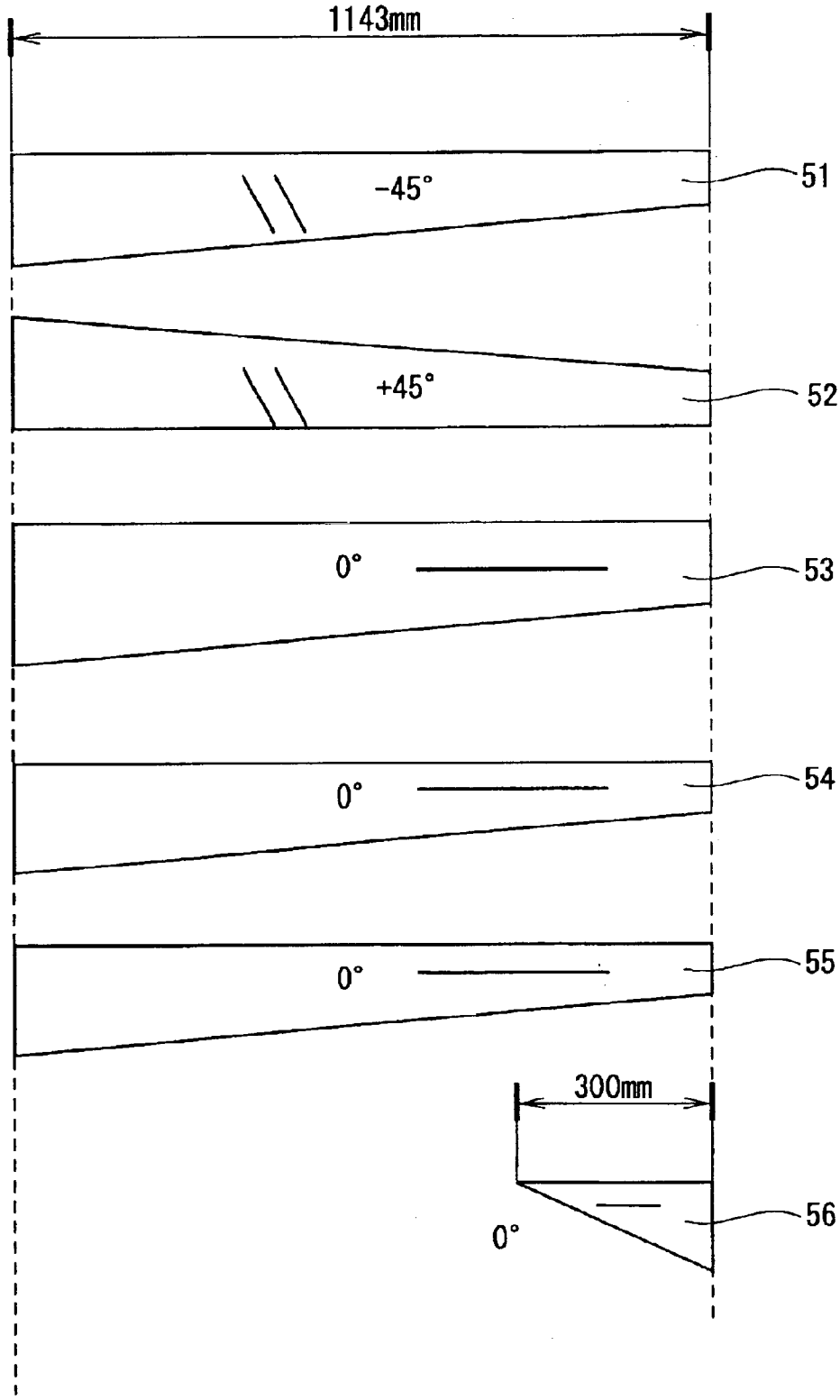
FIG. 6 shows a fiber reinforced prepreg for the use of a golf club shaft of a first comparison example.

The golf club shaft of the comparison example 1 had a layered construction shown in FIG. 6. The fiber reinforced prepregs 51→52→ . . . 56 were wound on a core metal sequentially from the inner peripheral side thereof and layered one upon another.

As fiber reinforced prepregs 51–55, MR350C-100S was used. As a fiber reinforced prepreg 56, TR350C-100S was used.

The lengths and fibrous angles of the fiber reinforced prepregs are as shown in FIG. 6.

The fiber reinforced prepreg 56 was wound eight times. The fiber reinforced prepregs 51 and 52 were wound three times respectively. The fiber reinforced prepreg 53 was wound twice. The fiber reinforced prepregs 54 and 55 were wound once respectively. The fiber reinforced prepregs were layered one upon another (number of times at the large-size side) to prepare a shaft by the above-described method.

Table 2 shown below shows the results of evaluations of the length of the golf club shaft of each of the examples 1–4 and the comparison example 1, the weight of each shaft, the diameter of TIP (outer diameter at head side), the diameter of BUTT (outer diameter at grip side) the feeling of flexibility, the feeling of stiffness, the flight distance, and the directional property.

TABLE 2

| | Length (mm) | Weight (g) | TIP diameter (mm) | BUTT diameter (mm) |
|---|---|---|---|---|
| CE1 | 1143 | 57 | 9.0 | 15.5 |
| E1 | 1143 | 55 | 9.0 | 15.7 |
| E2 | 1143 | 61 | 9.0 | 15.7 |
| E3 | 1143 | 59 | 9.0 | 16.8 |
| E4 | 1143 | 54 | 9.0 | 15.4 |

| Feeling of flexibility | Feeling of stiffness | Flight distance (yard) | Directional property (yard) |
|---|---|---|---|
| 2.8 | 2.2 | 221 | 36.5 |
| 3.6 | 4.1 | 238 | 26.2 |
| 4.2 | 3.8 | 243 | 21.3 |
| 3.9 | 4.0 | 242 | 23.8 |
| 3.6 | 3.9 | 236 | 25.8 |

Where CE denotes comparison example, and E denotes example of the present invention.

*Test of Feeling of Flexibility and Feeling of Stiffness

To evaluate "feeling of flexibility" and "feeling of stiffness" of the golf club shaft of each of the examples 1–4 and the comparison example 1, an organoleptic test was conducted on golf players who hit golf balls. Evaluations were made for each golf club shaft by marking "5" on the golf club shaft for which golf players felt most flexible, "1" on the golf club shaft for which the golf players felt least flexible; "5" on the golf club shaft for which the golf players felt stiffest, and "1" on the golf club shaft for which the golf players felt least stiff. 10 testers hit golf balls. For the "feeling of flexibility" and the "feeling of stiffness", the average of the marks given by all the testers was shown in table 2.

*Test of Flight Distance and Directional Property

Each of the 10 testers hit five balls with drivers composed of the golf club shaft of each of the examples 1–4 and the comparison example 1 to evaluate the "flight distance" and the "directional property (flight direction)". The "flight distance" was expressed by the average of all the flight distances of golf balls hit by the 10 testers. The "directional property" was expressed by the average of the distances (deviation) between the line (target direction) connecting the hitting position and the target point and a position where the golf ball reached. Table 3 shows the results of evaluations.

As shown in table 2, the evaluated marks of the "feeling of flexibility" of the examples 1–4 were in the range of 3.6–4.2, whereas the evaluated mark of the "feeling of flexibility" of the comparison example 1 was 2.8. Thus, the "feeling of flexibility" of the examples 1–4 was better than that of the comparison example 1. The evaluated marks of the "feeling of stiffness" of the examples 1–4 were in the range of 3.8–4.1, whereas that of the comparison example 1 was 2.2. Thus, the "feeling of stiffness" of the examples 1–4 was better than that of the comparison example 1.

The "flight distances" of the examples 1–4 were in the range of 236–243 yards, whereas the "flight distance" of the comparison example 1 was 221 yards. Thus, the "flight distance" of the examples 1–4 was longer than that of the comparison example 1. The "directional properties (flight direction)" of the examples 1–4 were in the range of 21.3–26.2 yards, whereas that of the comparison example 1 was 36.5 yards. Thus, the golf club shaft of the examples 1–4 was shorter than that of the comparison example 1 in the deviation of the golf ball with respect to the target direction.

As apparent from the going description, it could be confirmed that the golf club shaft of the examples of the present invention displayed superior performance in any of the items of the "feeling of flexibility", the "feeling of stiffness", the "flight distance", and the "directional property (flight direction)".

As apparent from the foregoing description, according to the present invention, the head-side reinforcing layer and the grip-side reinforcing layer are formed to make the rigidity of the head side of the shaft and that of the grip side thereof higher than that of the middle part thereof. Thereby it is possible to increase the flight distance owing to a high degree of flexibility of the shaft and make the flight direction uniform owing to a golfer's stable swing. Thus the golfer can have feeling of stiffness and feeling of flexibility.

More specifically, the shaft has the head-side reinforcing layer to increase the rigidity of the head side of the shaft. Thereby it is possible to prevent a flight direction from being varied and the golf ball from being hop-flight. Thus it is possible to allow the flight direction to be uniform. The shaft is provided with the grip-side reinforcing layer to increase the flexural rigidity of the grip part. Thereby it is possible to reduce the deformation amount of the grip part. Thus the golfer can feel the feeling of stiffness when the golfer swings. Thus it is unnecessary for the golfer to grasp the grip part tightly to prevent deformation of the grip part. That is, it is unnecessary for the golfer to exert all her/his power. Therefore, the golfer can swing in a stable form and fly the "flight direction" uniformly.

The number of prepregs of each of the head-side reinforcing layer and the grip-side reinforcing layer is plural. In each of the head-side reinforcing layer and the grip-side reinforcing layer, the length of at least one of the prepreg is different from that of other prepregs in the axial direction of the golf club shaft. Thus it is possible to allow the distribution of the rigidity of the shaft to be uniform. Therefore, the golfer can feel the feeling of stiffness at the grip part and the front end (head) of the shaft and the feeling of flexibility at the middle part thereof without feeling discomfort. That is, the golfer can obtain a preferable feeling.

What is claimed is:

1. A golf club shaft comprising:

a structure of a plurality of fiber reinforced prepreg layers layered one upon another, wherein a grip-side reinforcing layer is provided at a grip side of a shaft and a head-side reinforcing layer is provided at a head side of said shaft, wherein each of said grip-side reinforcing layer and said head-side reinforcing layer have a plurality of prepregs with lengths different from each other within the same grip-side reinforcing layer and said head-side reinforcing layer in an axial direction thereof (a longitudinal direction of said golf club shaft); in each of said grip-side reinforcing layer and said head-side reinforcing layer, the number of layers of said prepregs disposed only at both ends of said golf club shaft is set larger than that of layers thereof disposed at a middle part of said golf club shaft; and ends of said prepregs of said head-side reinforcing layer disposed at said middle part of said golf club shaft and those of said prepregs of said grip-side reinforcing layer disposed at said middle part of said golf club shaft do not overlap each other, respectively, wherein a position of a head-side end of said prepregs of said head-side reinforcing layer and a position of a grip-side end of said prepreg of said grip-side reinforcing layer are set to a range of not less than 0% nor more than 25% of an entire length of said golf club from each of both ends of said shaft, wherein a length of each of said prepregs of each of said head-side reinforcing layer and said grip-side reinforcing layer in said axial direction thereof ranges from not less than 5% to not more than 35% of the entire length of said golf club shaft;

wherein said grip-side reinforcing layer has a straight layer composed of said prepregs having fibrous angles of 0° with respect to said axial direction of said golf club shaft, wherein said middle part of said golf club shaft is provided with a non-reinforcing portion where said prepregs of said head-side reinforcing layer and said prepregs of said grip-side reinforcing layer are not disposed; and a length of said non-reinforcing portion ranges from not less than 10% to not more than 60% of the whole length of said golf club shaft.

2. The golf club shaft according to claim 1, wherein a position of said grip-side end of said prepregs of said grip-side reinforcing layer disposed is set to a range of not less than 4% nor more than 10% of the whole length of said golf club shaft from said grip-side end of said shaft.

3. The golf club shaft according to claim 1, wherein said head-side reinforcing layer and said grip-side reinforcing layer are extended from a head-side end of the shaft and a grip-side end thereof respectively, with said head-side ends of said prepregs thereof coincident with one another in an axial direction of said golf club shaft and with said grip-side ends of said prepregs thereof coincident with one another in said axial direction thereof; and the number of layers of said prepregs is gradually decreased toward said middle part of said golf club shaft to thereby gradually increase a rigidity of said golf club shaft from said middle part to the end of a grip part thereof and to the end of a head part thereof.

4. The golf club shaft according to claim 1, wherein said head-side reinforcing layer has a bias layer composed of said prepregs having fibrous angles of ±30°–±50° with respect to said axial direction of said golf club shaft.

5. The golf club shaft according to claim 1, wherein an end portion of said prepreg of each reinforcing layer disposed at the middle part of the shaft is cut to make each reinforcing layer stepwise naturally, so that a smooth distribution of the rigidity of each reinforcing layer is accomplished.

6. The golf club shaft according to claim 1, wherein the grip-side layers are disposed in a range 4–10% of the whole length of the shaft from the grip end.

7. The golf club shaft according to claim 6, wherein the shape of the shaft is formed as a taper from the head-end to the grip-end.

8. The golf club shaft according to claim 1, wherein the shape of the shaft is formed as a taper from the head-end to the grip-end.

* * * * *